United States Patent [19]

Sorensen

[11] Patent Number: 5,034,725

[45] Date of Patent: Jul. 23, 1991

[54] SEMICONDUCTOR GAS SENSOR HAVING LINEARIZED INDICATIONS

[76] Inventor: Thomas C. Sorensen, 11165 Willow Wood Dr., Roswell, Ga. 30077

[21] Appl. No.: 551,542

[22] Filed: Jul. 11, 1990

[51] Int. Cl.[5] ..... G08B 17/10

[52] U.S. Cl. ..... 340/632; 73/23.2

[58] Field of Search ..... 340/632, 633, 634; 73/23.21, 23.31, 23.32, 23.2

[56] References Cited

U.S. PATENT DOCUMENTS

| | | | |
|---|---|---|---|
| 4,028,057 | 6/1977 | Nelson | 340/633 X |
| 4,235,096 | 11/1980 | Yasuda et al. | 73/23.31 |
| 4,258,563 | 3/1981 | Yasuda et al. | 73/23.31 |

*Primary Examiner*—Joseph A. Orsino
*Assistant Examiner*—Jeffery A. Hofsass
*Attorney, Agent, or Firm*—Rodgers & Rodgers

[57] ABSTRACT

Atmospheric concentrations of reducing gases are measured and indicated by a gas sensor whose conductivity varies in accordance with variations in the concentration of ambient reducing gases, a resistance in series with the gas sensor for establishing a reference voltage, a circuit interconnecting the resistance with a linearizing circuit including the non-inverting inputs of a plurality of voltage comparators and with the inverting input of a fault detecting comparator, an adjustable resistance of a magnitude substantially equal to the response of the sensor at its maximum value, a thermistor in parallel with a fixed resistance and in series with the adjustable resistance and with a voltage divider including a plurality of fixed resistors respectively connected with the inverting inputs of the plurality of voltage comparators together with a light emitting diode in series with the output of each voltage comparator, each light emitting diode indicating a concentration of an ambient reducing gas in terms of parts per million, and the non-inverting input of the fault detecting comparator is connected with a reference voltage to indicate an open circuit condition.

14 Claims, 1 Drawing Sheet

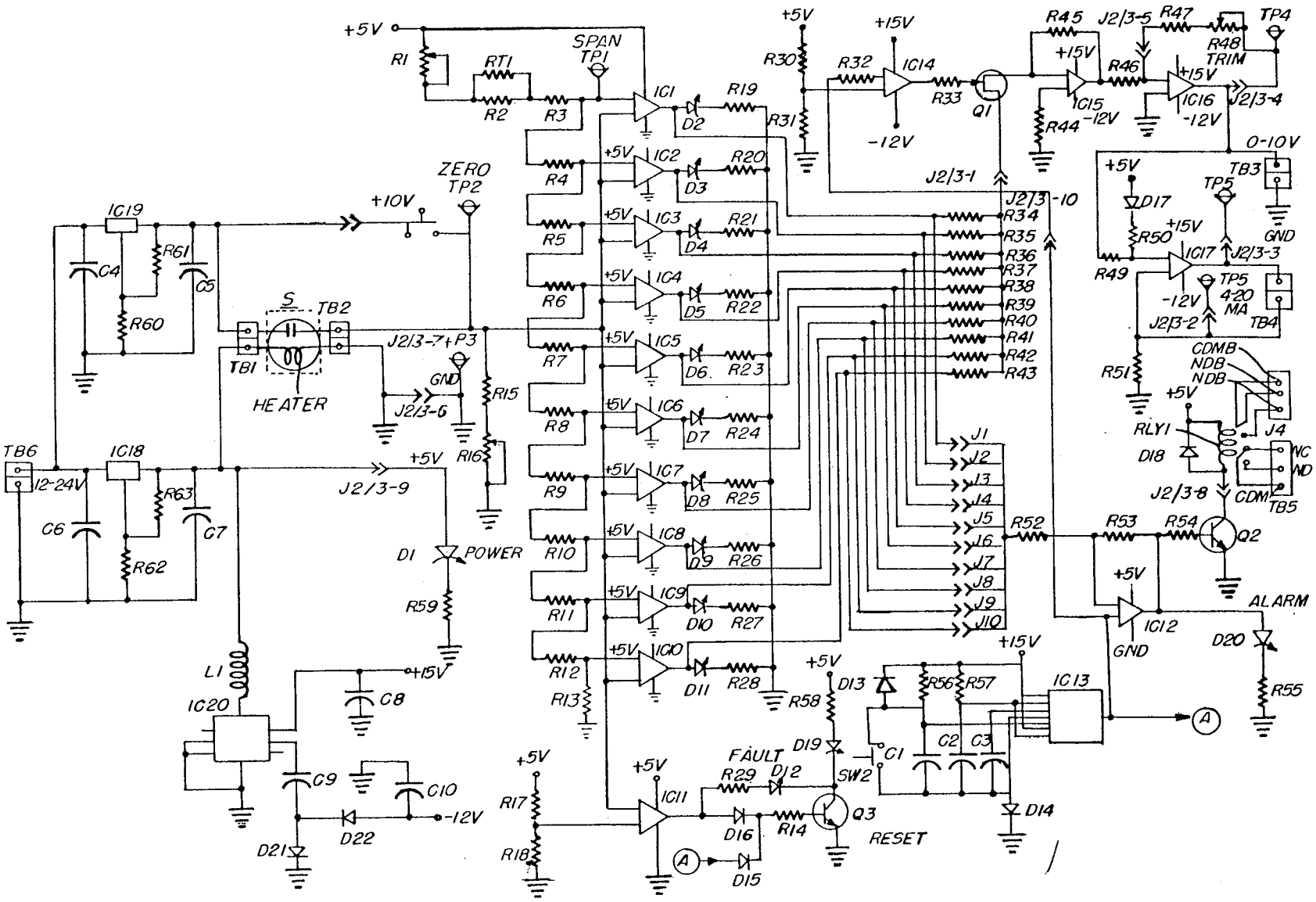
TP4
R48 TRIM
R47
R46
R45
R44
IC16
IC15
IC14
Q1
R33
R32
R30
R31
J2/3-4
J2/3-5
J2/3-1
J2/3-10
0-10V
TB3
TP5
GND
J2/3-3
TB4
4-20 MA
IC17
R50
R49
D17
J2/3-2
R51
COMB
NDB
NDB
J4
NC
NO
COM
TB5
RLY1
D18
J2/3-8
Q2
R54
R53
R52
ALARM
D20
R55
IC12
IC13
D14
R57
R56
C1
C2
C3
RESET
SW2
Q3
D13
R58
D19
D12
R14
FAULT
R29
D16
D15
IC11
R17
R18
R19
R20
R21
R22
R23
R24
R25
R26
R27
R28
D2
D3
D4
D5
D6
D7
D8
D9
D10
D11
IC1
IC2
IC3
IC4
IC5
IC6
IC7
IC8
IC9
IC10
SPAN TP1
R3
R4
R5
R6
R7
R8
R9
R10
R11
R12
R13
RT1
R2
R1
ZERO TP2
R15
R16
J2/3-7
P3
J2/3-6
POWER
D1
R59
C8
C10
D22
C9
D21
L1
IC20
+10V
TB2
S
HEATER
TB1
J2/3-9
C5
R61
R60
C4
IC19
C7
R63
R62
IC18
C6
12-24V
TB6

SEMICONDUCTOR GAS SENSOR HAVING LINEARIZED INDICATIONS

TECHNICAL FIELD

This invention relates to the detection and measurement of atmospheric concentrations of reducing gases.

BACKGROUND ART

U. S. Pat. No. 4,235,096 for Gas Detection Apparatus and which issued Nov. 25, 1980 discloses a gas detecting device exposed to exhaust gases in which the detecting device is arranged in series with a reference resistor and compares the voltage at the dividing point between the gas detection element and the reference resistor to determine via a plurality of comparators whether the voltage at the voltage dividing point between the gas detection element and the referenced resistor exceeds a predetermined range or not.

U. S. Pat. No. 4,258,563 for Gas Sensor issued Mar. 31, 1981 discloses an arrangement wherein a predetermined voltage is applied across a series circuit including a gas sensing element and a reference resistor to detect the gas composition in an exhaust gas by a voltage at the junction point between the gas sensing element and the reference resistor. Provision is made for monitoring the voltage at the junction point and another circuit responsive to the monitoring circuit for changing the resistance of the reference resistor so that when the voltage at the junction point exceeds a predetermined range, the resistance of the reference resistor is changed to effect a correct reading if the resistance of the gas sensing element changes with operating temperature or with time.

SUMMARY OF THE INVENTION

According to this invention in one form, a combination of semiconductor elements for measuring atmospheric concentrations of reducing gases comprises a gas sensor whose conductivity varies in accordance with variations in the concentration of ambient reducing gases, resistance means in series with said gas sensor for establishing a reference voltage, circuit means interconnecting said resistance means with the non-inverting inputs of a plurality of voltage comparators, an adjustable resistance means of a magnitude substantially equal to the response of said sensor at its maximum value, a thermistor in parallel with a fixed resistance and in series with said adjustable resistance means and with a voltage divider which includes a plurality of fixed resistors respectively connected with the inverting inputs of said plurality of voltage comparators together with a light emitting diode in series with the output of each of said comparators each light emitting diode being arranged to indicate a concentration of reducing gas in parts per million. Provision is also made for fault detection wherein the inverting input of a fault detecting comparator is connected with said circuit means and the non-inverting input of said comparator is connected with a reference voltage to indicate an open circuit condition.

BRIEF DESCRIPTION OF THE DRAWING

The FIG. shows a schematic drawing of a semiconductor gas sensor.

BEST MODE OF CARRYING OUT THE INVENTION

With reference to the single figure drawing, a gas sensor S whose conductivity varies in accordance with variations in the concentration of ambient reducing gases is connected in series with resistance means R15 and with adjustable resistance means R16. The gas sensor S and resistance means R15 and R16 are connected in series with the non-inverting inputs of a plurality of voltage comparators IC1 -IC10. An adjustable resistance means R1 is connected in series with a source of potential and in series with the parallel connected fixed resistor R2 and the thermistor RT1. The series resistor network R3-R13 constitutes a voltage divider circuit that sets a precision reference voltage to the inverting input of each of the voltage comparators ICl-IC10. This reference voltage is determined by calculating the values of the resistor network based on empirical response data of the sensor S. Light emitting diodes D2-D11 and resistors R19-28 are connected to the outputs of comparators IC1-IC10 respectively. These diodes indicate gas concentration in parts per million by lighting in the sequence beginning with the lowest value of such concentrations being indicated by diode D11 and the ultimate concentration being indicated by light emitting diode D2. When the voltage from the sensor equals the voltage at a reference input, the appropriate voltage comparator output goes high (approximately 9 volts turning on its associated light emitting diode to indicate parts per million of gas concentration. Since comparators are used as long as the gas concentration voltage is equal to or greater than the reference voltage, the output remains high and its associated LED remains on.

A power supply network provides the means for generating the various voltages required for proper operation of the components. A 12 to 24 Vdc unregulated positive voltage is applied to terminal block TB6. The positive side of TB6 connects to precision voltage regulators IC18 and IC19. Resistor R61 sets a reference voltage with R60 to IC19 thus setting the output to the desired value of 10 Vdc. Resistor R63 and R64 are arranged in similar manner to IC18 to output 5Vdc. Capacitors C4-C7 improve transient response or insure output stability.

IC20 is a step-up switching regulator which provides 15Vdc from a 5Vdc supply. This IC also contains a charge pump that combines with capacitor C9 and diodes D21 and D22 to provide −12Vdc. Capacitors C8 and C10 smooth any ripple in the output.

The outputs of the comparators IC1-IC10 are connected respectively with a summing network comprising a plurality of equal fixed resistors R34-R43. The outputs of the resistors R34-R43 are equal and are interconnected with each other and with an inverting amplifier IC15 through transistor Q1 to summarize the outputs of the comparators to a scaled value determined by R44 and R45.

The output of IC15 is interconnected with the inverting input of inverting amplifier IC16 to provide a positive 0-10 volt output that is a linear representation of the percentage of gas concentration. Resistors R46-R48 set the amplifier gain allowing the output to be precisely set. This output is in turn fed to IC17 through R49 which converts the positive voltage to the 4-20 mA current. Resistor R50 supplies the 4 mA offset current at 0 volts input. Register R51 determines the maximum current available to allow 20 mA output with a 10V input.

Each of the outputs of the voltage comparators IC-1-IC10 is connected to a branch of one side of the jumper block J1–J10. By shorting one of the jumper switches the user has the option of sending any one of the ten outputs to the alarm driver IC12 R52, R53 and the relay driver Q2 and R54 and thus to the alarm indicator and relay. D18 protects the relay coil from reverse bias.

Fault detection is effected by op-amp ICll and resistors R17 and R18. The op-amp is configured as a voltage comparator and series resistors R17 and R18 form a reference voltage set at approximately seven tenths —eight tenths volts. If the sensor S opens or its feeder fails, its resistance approaches infinity and the output voltage falls to zero volts. Since this voltage is on the inverting input to ICll when it drops below the reference voltage, the output of ICll goes high and the "FAULT" LED (D12) lights. It should be noted that the diodes D15 and D16, resistor R14 and transistor Q3 are required only because a three terminal bi-color LED has been chosen for the "FAULT" and "RESET." indicators.

Both local alarms (LED, relay and audible) and remote outputs (0–10 volts and 4–40 mA) are suppressed when power is first applied or when the reset button is depressed. On power up, resistor R56 and capacitor Cl hold the timer's trigger output (IC13) low approximately seven tenths volt as determined by diode D14 for a brief time causing the output to go high for a period set by resistor R57 and capacitor C2. This holds the output of comparator IC12 low and therefore inhibits the alarm LED and relay. The timer output also connects to comparator IC14 through R32. The reference voltage is set by R30 and R31 to hold comparator IC14 low, turning transistor Q1 "off" and isolating the summer network from IC15. 0–10V output is held to zero volts. The 4–20 mA is then held at 4 mA. This suppressed condition is indicated by the reset LED D19. Pressing switch SW2 (reset) also pulls the timer's trigger input low having the same result as R56 and C1 on power up.

I claim:

1. A combination which includes semiconductor elements for measuring atmospheric concentrations of reducing gases comprising a gas sensor whose conductivity varies in accordance with variations in the concentration of ambient reducing gases, resistance means in series with said gas sensor for establishing a reference voltage, circuit means interconnecting said resistance means with the non-inverting inputs of a plurality of voltage comparators, an adjustable resistance means of a magnitude substantially equal to the response of said sensor at its maximum value, a thermistor in parallel with a fixed resistance and in series with said adjustable resistance means and with a voltage divider comprising a plurality of fixed resistors respectively connected with the inverting inputs of said plurality of voltage comparators, and a light emitting diode in series with the output of each of said comparators for selectively indicating a particular degree of ambient reducing gas concentrations.

2. A combination of semi conductor elements according to claim 1 wherein said gas sensor includes a heater and wherein the resistance of, said sensor is inversely proportional to the ambient reducing gas concentration when the voltage of said heater is held constant.

3. A combination of semiconductor elements according to claim 2 wherein the resistance of said sensor varies in a non linear fashion and wherein said thermistor compensates for changes in said sensor due to temperature changes.

4. A combination of semiconductor elements according to claim 1 wherein said voltage divider establishes a precision reference voltage to the inverting input of each said comparators.

5. A combination of semiconductor elements according to claim 4 wherein said precision reference voltages are determined in conjunction with empirical response data of said sensor.

6. A combination of semiconductor elements according to claim 5 wherein gas concentration in parts per million is indicated by sequential energization of said light emitting diodes in accordance with increasing concentration of gas.

7. A combination of semiconductor elements according to claim 6 wherein a particular comparator output goes high and its associated light emitting diode is turned on in coordination with the equalization of the sensor voltage and the voltage at the associated fixed resistor thereby to indicate parts per million visually.

8. A combination of semiconductor elements according to claim 1 wherein a summing network includes a plurality of equal fixed resistors to which the outputs of the comparators are respectively connected and the outputs of which are interconnected with each other and with an inverting amplifier to combine the outputs of said comparators to a scaled value.

9. A combination of semiconductor elements according to claim 8 wherein the scaled value of said combined output is supplied to an inverting amplifier to provide a positive output that is a linear representation of the percentage of gas concentration.

10. A combination of semiconductor elements according to claim 9 where said positive output is converted to an output of 4–20 mA.

11. A combination of semiconductor elements according to claim 1 wherein the outputs of said comparators are respectively connected with one terminal of a multiple position selector the other terminal of each of which is connected with the inverting input of an alarm device and to an alarm indicator and a relay.

12. A combination of semiconductor elements according to claim 1 wherein the inverting input of a fault detecting comparator is connected with said circuit means and the non-inverting input of said comparator is connected with a reference voltage indicating an open condition.

13. A combination of semiconductor elements according to claim 12 wherein the output of said fault detecting comparator is connected with a light emitting diode which is energized in response to failure of said sensor when the sensor output voltage is zero which results in a high output of said fault detecting comparator.

14. A combination of series conductor elements according to claim 13 wherein a pair of parallel connected diodes are connected in series with a resistor and with the base of a transistor the collector of which is connected with a reset diode to provide fault and reset indications.

* * * * *